US006175293B1

(12) United States Patent
Hasegawa et al.

(10) Patent No.: US 6,175,293 B1
(45) Date of Patent: Jan. 16, 2001

(54) PLANAR INDUCTOR

(75) Inventors: Michio Hasegawa; Masashi Sahashi, both of Yokohama (JP)

(73) Assignee: Kabushiki Kaisha Toshiba, Kawasaki (JP)

( * ) Notice: Under 35 U.S.C. 154(b), the term of this patent shall be extended for 0 days.

(21) Appl. No.: 08/059,350

(22) Filed: May 11, 1993

Related U.S. Application Data

(63) Continuation of application No. 07/414,455, filed on Sep. 29, 1989, now abandoned.

(30) Foreign Application Priority Data

Sep. 30, 1988 (JP) ..... 63-246432
Sep. 30, 1988 (JP) ..... 63-246433
Jan. 24, 1989 (JP) ..... 1-14613

(51) Int. Cl.[7] ..... H01F 15/02; H01F 27/30
(52) U.S. Cl. ..... 336/83; 336/150; 336/200; 336/232; 336/234
(58) Field of Search ..... 336/83, 180, 200, 336/232, 234, 233, 206, 212, 181

(56) References Cited

U.S. PATENT DOCUMENTS 3,798,059 3/1974 Astle et al. ..... 336/200
3,833,872 * 9/1974 Marcus et al. ..... 336/232
4,021,705 * 5/1977 Lichtblau ..... 361/402
4,322,698 * 3/1982 Takahashi et al. ..... 336/200
4,494,100 * 1/1985 Stapel et al. ..... 336/200
4,613,843 * 9/1986 Esper et al. ..... 336/200
4,709,221 11/1987 Kadokura et al. ..... 336/200
4,959,631 * 9/1990 Hasegawa et al. ..... 336/200

FOREIGN PATENT DOCUMENTS

3908896 * 9/1989 (DE) ..... 336/200
271657 * 6/1988 (EP) ..... 336/234
0310396 4/1989 (EP) .

OTHER PUBLICATIONS

Technical University Delft, pp. 3.47, Jul. 1983, E. Hommes, et al., "Electrische Machines".

* cited by examiner

*Primary Examiner*—Michael L. Gellner
*Assistant Examiner*—Anh Mai
(74) *Attorney, Agent, or Firm*—Oblon, Spivak, McClelland, Maier & Neustadt, P.C.

(57) ABSTRACT

A planar inductor has a spiral coil, insulating layers stacked on both surfaces of the spiral coil, and ferromagnetic layers stacked on the insulating layers, wherein each ferromagnetic layer has a saturation magnetization $4\pi M_S$ of 10 kG or more, and a thickness of 100 $\mu$m or less.

45 Claims, 16 Drawing Sheets

PLANAR INDUCTOR

This application is a continuation of application Ser. No. 07/414,455, filed on Sep. 29, 1989, now abandoned.

BACKGROUND OF THE INVENTION

1. Field of the Invention

The present invention relates to a planar inductor applied to, e.g., a DC-to-DC converter.

2. Description of the Related Art

A conventional ferrite troidal coil has been used as a choke coil on the output side of, e.g., a DC-to-DC converter. In contrast to this, a planar inductor has been recently studied in order to achieve miniaturization of an apparatus.

For example, a planar inductor with a structure having a spiral or meander planar coil, insulating layers stacked on both surfaces of the planar coil, and ferromagnetic layers stacked on the insulating layers is known.

In order to obtain high inductance, an amorphous alloy ribbon having a high permeability is used as a ferromagnetic layer. Note that many amorphous alloys have a positive saturation magnetostriction. Thus, when an amorphous alloy having a saturation magnetostriction is used as a normal troidal magnetic core, complicated magnetic anisotropy occurs during a heat treatment for eliminating strain by an inverse magnetostrictive effect due to a flexural stress, and soft magnetic properties such as an effective permeability are degraded. On the other hand, when an amorphous alloy is applied to a planar inductor, a ribbon of the alloy is used in a planar state. Therefore, the above-mentioned degradation of soft magnetic property due to an inverse magnetostrictive effect is small, and the soft magnetic property of the alloy can be sufficiently utilized. Therefore, in the troidal magnetic core and the planar inductor, a ferromagnetic ribbon need not be treated in the same manner.

When the planar inductor is applied to a choke coil on the output side of, e.g., a DC-to-DC converter, a high-frequency current superposed with DC current is supplied to the planar inductor. Therefore, excellent DC superposition characteristics are required.

The conventional planar inductor, however, undesirably has poor DC superposition characteristics. This problem is caused because the magnetic characteristics of a ferromagnetic ribbon which has been conventionally used are inadequate. More specifically, in the planar inductor, a magnetic flux flows in a plane of a surface of the ferromagnetic ribbon. When the saturation magnetization of the ferromagnetic ribbon is low, however, even if a small DC magnetic field is superposed, a magnetic flux density is saturated. Although the ferromagnetic ribbon having a high permeability is used in order to obtain higher inductance, an inductance is reduced, thus degrading DC superposition characteristics. For example, a ferromagnetic ribbon having a high permeability consisting of a Co-based amorphous alloy is known, and its saturation magnetization is higher than that of a ferrite. However, this saturation magnetization is insufficient to prevent a reduction in inductance, and the DC superposition characteristics are degraded.

Assume that a Co-based amorphous alloy is used as a ferromagnetic ribbon. If the Co-based amorphous alloy ribbons are stacked, the DC superposition characteristics can be improved to some extent. However, if a large number of amorphous alloy ribbons are stacked, the thickness of the planar inductor is increased. Therefore, in consideration of an object to obtain a thin planar inductor, stacking a large number of amorphous alloy ribbons is not preferable.

If the DC superposition characteristics of the planar inductor are poor, a inductance is reduced, and a control becomes difficult. Accordingly, the efficiency of a DC-to-DC converter is lowered. Thus, it is inadequate to apply the planar inductor directly to, the DC-to-DC converter and the like. Therefore, in order to improve the DC superposition characteristics, a high saturation magnetization of a ferromagnetic ribbon having a high permeability is required.

Even if the DC superposition characteristics on the inductance can be improved, an improvement of the efficiency of the DC-to-DC converter to which the planar inductor is applied is limited due to a high-frequency loss of the ferromagnetic ribbon. Therefore, in order to obtain a high efficiency equivalent to that of a conventional ferrite troidal coil, a high-frequency loss of the ferromagnetic ribbon must be decreased.

In addition, the planar inductor is used in practice while being coated with a mold resin. For this reason, if the amorphous alloy ribbon has a positive saturation magnetostriction, when the surface of the planar inductor is coated with a liquid mold resin and the resin is hardened, a compressive stress is applied to the ferromagnetic ribbon upon contraction of the mold resin. An effective permeability is then decreased due to an inverse magnetostrictive effect, thus reducing an inductance.

SUMMARY OF THE INVENTION

It is an object of the present invention to provide a planar inductor having excellent DC superposition characteristics. It is another object of the present invention to provide a planar inductor which suppresses a high-frequency loss of a ferromagnetic layer, and does not decrease in efficiency even when applied to a DC-to-DC converter. It is still another object of the present invention to provide a planar inductor which can prevent a reduction in inductance even if it is covered with a mold resin.

According to the present invention, there is provided a planar inductor having a planar inductance element, an insulating layer stacked on the inductance element, and a ferromagnetic layer stacked on the insulating layer, the ferromagnetic layer having a saturation magnetization $4\pi M_S \geqq 10$ kG, and a thickness of 100 $\mu$m or less. In such a planar inductor according to the present invention, DC superposition characteristics are improved. This planar inductor can be effectively applied to, e.g., a DC-to-DC converter.

In the planar inductor according to the present invention, the ferromagnetic layer is preferably two-dimensionally divided into a plurality of portions. If the ferromagnetic layer which constitutes the planar inductor is two-dimensionally divided into a plurality of portions, a high-frequency loss can be decreased, and the efficiency of the DC-to-DC converter to which such a planar inductor is applied can be improved.

When the planar inductor according to the present invention is used in practice, a relaxation layer for contraction of a mold resin is preferably formed on a surface of the ferromagnetic layer, and the entire members are coated with a mold resin. Thus, if the relaxation layer is stacked on the surface of the ferromagnetic layer, contraction generated when the mold resin is hardened and contracted can be relaxed, and transmission of the contraction to the ferromagnetic layer can be prevented, thus preventing a reduction in inductance due to an inverse magnetostrictive effect.

DETAILED DESCRIPTION OF THE PREFERRED EMBODIMENTS

Figure 1A:
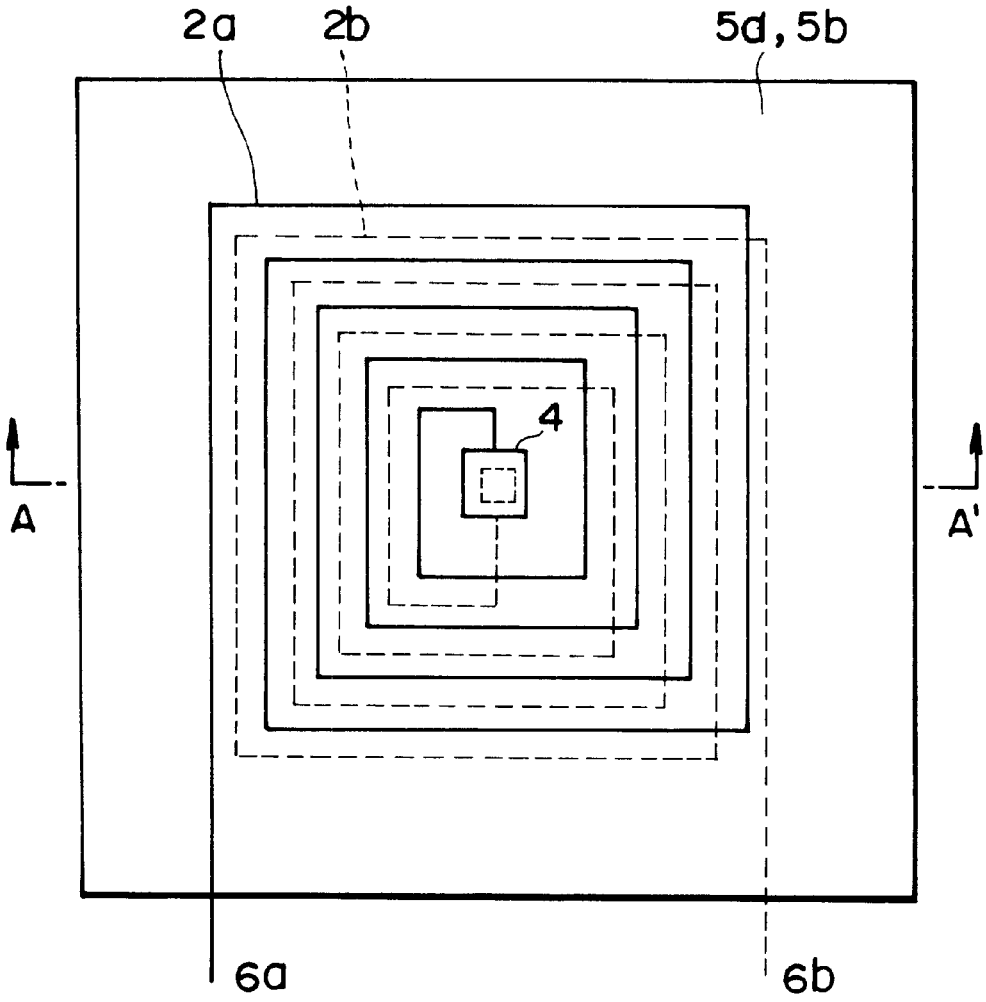
FIG. 1A is a plan view of planar inductors according to Examples 1 to 3 and Comparative Example 1 of the present invention.

In the present invention, a planar inductance element consists of, e.g., a spiral or meander coil. The spiral coil normally has a two-layered structure obtained by forming spiral conductors on the front and rear surfaces of an insulating layer, and connecting the conductors via a through hole. Note that if a terminal can be extracted without a problem, a spiral coil having only one layer of a spiral conductor can be used.

The planar inductance element may be formed by stacking a plurality of spiral or meander coils. When these coils are stacked, an inductance is increased. In this case, a ferromagnetic layer is not preferably inserted between the coils, but only an insulating layer is inserted. This is because even if a ferromagnetic layer is inserted between the coils, it hardly contributes to an increase in inductance, but increases the thickness of the entire planar inductor to reduce an inductance per unit volume.

In the present invention, the insulating and ferromagnetic layers may be stacked on one or both surfaces of the planar inductance element.

In the present invention, one or a plurality of ferromagnetic layers may be stacked.

A saturation magnetization $4\pi M_S$ of the ferromagnetic layer is set to be 10 kG or more because if the saturation magnetization $4\pi M_S$ is less than 10 kG, DC superposition characteristics of the planar inductor are degraded.

The thickness of the ferromagnetic layer is 100 $\mu$m or less for the following reasons. Assume that the planar inductor is applied to, e.g., a DC-to-DC converter, and it is used in a frequency band of 10 kHz or more. If the thickness of the ferromagnetic layer exceeds 100 $\mu$m, a generated magnetic flux does not enter inside the layer due to a surface effect. Thus, an inductance is not increased in proportion to an increase in thickness of the ferromagnetic layer, and an inductance per unit volume is reduced. Note that the thickness of the ferromagnetic layer is preferably 4 $\mu$m or more. If the thickness of the ferromagnetic layer is less than 4 $\mu$m, a sectional area required for passing all the magnetic fluxes generated by supplying a current to a coil cannot be obtained. Therefore, leaked magnetic fluxes are increased, and the inductance is considerably reduced, thus reducing an inductance per unit volume.

When a plurality of ferromagnetic layers are stacked, each ferromagnetic layer must satisfy the above-mentioned conditions.

In the present invention, the ferromagnetic layer preferably has an effective permeability $\mu$10 k of $1\times10^4$ or more at a frequency of 10 kHz. When such a ferromagnetic layer is used, a planar inductor having high inductance can be obtained.

For example, an amorphous alloy ribbon represented by the following formula is used as a ferromagnetic layer in the present invention:

$$(Fe_{1-a}M_a)100\text{-}b^Xb$$

where M is at least one of Ti, V, Cr, Mn, Co, Ni, Zr, Nb, Mo, Hf, Ta, W, and Cu, and X is at least one of Si, B, P, C, Ge, and Al, and $0 \leqq a \leqq 0.15$, and $12 \leqq b \leqq 30$).

A function and a composition ratio of each element which constitutes the amorphous alloy ribbon will be described hereinafter.

The element M is a component which contributes to an improvement of a permeability in a high-frequency region and an increase in crystallization temperature. Even if a small amount of the component M is added, it exhibits the above-mentioned function. In practice, preferably, $a \geqq 0.01$. When $a>0.15$, it is not preferable in practice since a Curie temperature is extremely lowered.

The element X is necessary to obtain an amorphous state. In consideration of heat stability in practice, a combination of elements Si and B is preferable. Note that when $b<12$ and $b>28$, it is difficult to obtain an amorphous state, and hence preferably, $12 \leqq b \leqq 28$. More preferably, $15 \leqq b \leqq 25$. Si is preferably added in an amount of 2 to 13%, and preferably, 2 to 8%.

Most amorphous alloys with the above composition have saturation magnetizations of 10 kG or more. By performing an optimal heat treatment for eliminating strain, an effective permeability of $1\times10^4$ or more can be obtained.

In order to achieve an object of the present invention, in particular, a ferromagnetic layer having an extremely high saturation magnetization and permeability is preferably used. For example, a hyperfine grain alloy ribbon obtained by thermally treating an amorphous alloy ribbon having a composition of $Fe_{73.5}Cu_1Nb_3Si_{13.5}B_9$ at a temperature higher than a crystallization temperature is used as a ferromagnetic layer having the above excellent characteristics (see EP 271,657). This magnetic alloy ribbon has a high permeability (an effective permeability $\mu 10k=5\times10^4$ at a frequency of 10 kHz), and a high saturation magnetization ($4\pi M_s=13.5$ kG). When such a magnetic alloy ribbon is used, a planar inductor having a high inductance and excellent DC superposition characteristics can be obtained.

In the present invention, the ferromagnetic layer which constitutes the planar inductor is preferably two-dimensionally divided into a plurality of portions. When the ferromagnetic layer is two-dimensionally divided into a plurality of portions, a high-frequency loss can be decreased, and the efficiency of a DC-to-DC converter manufactured using such a planar inductor is improved for the following reasons. That is, an effective resistance component R of an impedance Z is represented as follows:

$$R=2\pi f\cdot L\cdot \tan\delta$$

where f is the frequency, L is the inductance, and tan δ is the high-frequency loss. As is apparent from the above equation, R is in proportion to the high-frequency loss tan δ. When the ferromagnetic layer is divided into a plurality of portions, an eddy current loss tan δ is decreased so that R is decrease. For example, an efficiency η of a noninsulated voltage-drop type DC-to-DC converter having an inductance on its output side is approximately represented by $\eta=100R_L/(R_L+R)(\%)$ (where RL is the load resistance). Therefore, when the value of R is smaller, the efficiency of the DC-to-DC converter is improved.

When the planar inductor according to the present invention is incorporated and used in an apparatus in practice, the entire inductor is coated with a mold resin, as described above. In this case, e.g., an organic polymer film having a thermal deformation temperature higher than a hardening temperature of the mold resin is preferably stacked on a surface of the ferromagnetic layer as a relaxation layer for contraction of the mold resin. While the side surfaces of the planar inductor are sealed with an adhesive, the entire inductor is coated with the mold resin. Thus, if the organic polymer film having a thermal deformation temperature higher than a hardening temperature of the mold resin is stacked on the surface of the ferromagnetic layer, contraction generated when the mold resin is hardened and contracted can be relaxed, and transmission of the contraction to the ferromagnetic ribbon or its stacked body is prevented, thus preventing a reduction in inductance due to an inverse magnetostrictive effect.

For example, polyphenylenesulfide (PPS) is used as an organic polymer film having a high thermal deformation temperature which is used as a relaxation layer. Note that if a similar effect can be obtained, the relaxation layer is not limited to the organic polymer film, as a matter of course. The thickness of such a relaxation layer is preferably 20 μm or more. If the thickness of the relaxation layer is less than 20 μm, wrinkles tend to be formed, and the contraction of the mold resin cannot be relaxed. The contraction is then transmitted to the ferromagnetic ribbon or its stacked body, and a reduction in inductance due to an inverse magnetostrictive effect cannot be prevented.

The present invention will be described below in detail by way of its examples.

EXAMPLES 1–3, AND COMPARATIVE EXAMPLE 1

Figure 1B:
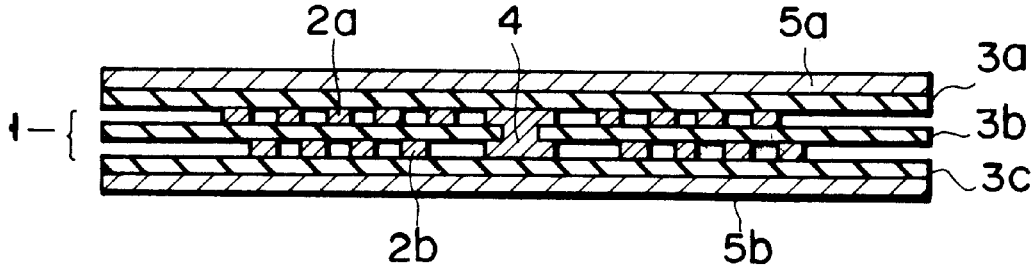
FIG. 1B is a sectional view taken along the line of A–A' of FIG. 1A.

A planar inductor having a structure showing FIGS. 1A and 1B was manufactured in Examples 1 to 3, and Comparative Example 1. Note that FIG. 1A is a plan view of the planar inductor, and FIG. 1B is a sectional view taken along the line of A–A' of FIG. 1A.

Referring to FIGS. 1A and 1B, a spiral coil 1 had a structure obtained by forming spiral conductors 2*a* and 2*b* on both surfaces of an insulating layer 3*b,* and electrically connecting the conductors 2*a* and 2*b* via a through hole 4. A current flowed through the conductors 2*a* and 2*b* in the same direction. Solid and broken lines in FIG. 1A denote the center lines of the conductors 2*a* and 2*b* located on the front and rear surfaces of the insulating layer 3*b,* respectively. Insulating layers 3*a* and 3*c* were respectively stacked on both the surfaces of the spiral coil 1, and ferromagnetic layers 5*a* and 5*b* were respectively stacked on the insulating layers 3*a* and 3*c,* thus the planar inductor was constituted. An inductance was formed between terminals 6*a* and 6*b* of the planar inductor including the above-mentioned members.

Such a planar inductor was manufactured in practice, as follows. Cu foils each having a thickness of 35 μm were applied on both surfaces of a polyimide film (the insulating layer 3*b*) having a thickness of 25 μm, and the Cu foils were connected via the through hole 4 in a central portion to prepare a double-sided FPC board (flexible printed circuit board). The Cu foils on both the surfaces were etched to obtain the conductors 2*a* and 2*b* each having an outer size of 20 mm×20 mm, a coil width of 250 μm, a coil pitch of 500 μm, and the number of turns of the coil of 40 (20 turns for each surface), thus manufacturing the spiral coil 1. Polyimide films (the insulating layers 3*a* and 3*c*) each having a thickness of 7 μm were stacked on both surfaces of the spiral coil 1, and square ferromagnetic ribbons (the ferromagnetic layers 5*a* and 5*b*) each having a side of 25 mm were further stacked on the polyimide films, respectively, thus manufacturing the planar inductor.

EXAMPLE 1

A square sample having a side of 25 mm was prepared from an amorphous alloy ribbon which had a composition of $(Fe_{0.95}Nb_{0.05})_{82}Si_6B_{12}$, a mean thickness of 16 μm, and a width of 25 mm, and which was manufactured by a single-roll method, and the sample was used as a ferromagnetic layer. In this amorphous alloy ribbon, an effective permeability $\mu_{10k}=1\times10^4$ at a frequency of 10 kHZ, and a saturation magnetization $4\pi M_S=12.3$ kG.

EXAMPLE 2

A square sample having a side of 25 mm was prepared from an amorphous alloy ribbon which had a composition of $Fe_{78}Si_9B_{13}$, a mean thickness of 16 μm, and a width of 25 mm, and which was manufactured by a single-roll method, and the sample was used as a ferromagnetic layer. In this amorphous alloy ribbon, an effective permeability μ10k=2,000 at a frequency of 10 kHZ, and a saturation magnetization $4\pi M_S=15.6$ kG.

EXAMPLE 3

A square sample having a side of 25 mm was prepared from a hyperfine grain alloy ribbon obtained by thermally treating in a nitrogen atmospher 550° C. for one hour an amorphous alloy ribbon, which had a composition of $Fe_{73.5}Cu_1Nb_3Si_{13.5}B_9$, a mean thickness of 18 μm and a width of 25 mm, and which was manufactured by a single-roll method, and the sample was used as a ferromagnetic layer. In this alloy ribbon, an effective permeability $\mu_{10k}=5\times10^4$ at a frequency of 10 kHZ, and a saturation magnetization 4πMs=13.5 kG.

COMPARATIVE EXAMPLE 1

A square sample having a side of 25 mm was prepared from an amorphous alloy ribbon which had a composition of $(Co_{0.88}Fe_{0.06}Nb_{0.02}Ni_{0.04})_{75}Si_{10}B_{15}$, a mean thickness of 16 μm, and a width of 25 mm, and which was manufactured by a single-roll method, and the sample was used as a ferromagnetic layer. In this amorphous alloy ribbon, an effective permeability $\mu_{10k}=2\times10^4$ at a frequency of 10 kHZ, and a saturation magnetization $4\pi M_S=6.7$ kG.

Figure 7:
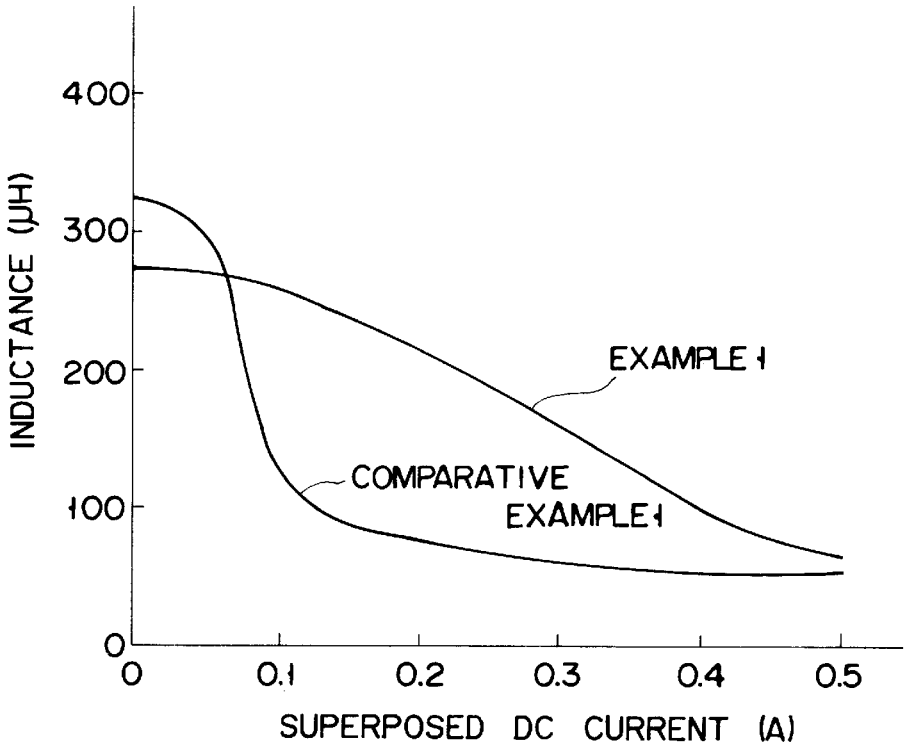
FIG. 7 is a graph showing a relationship between a superposed DC current and an inductance of each planar inductor according to Example 1 and Comparative Example 1 of the present invention.
Figure 8:
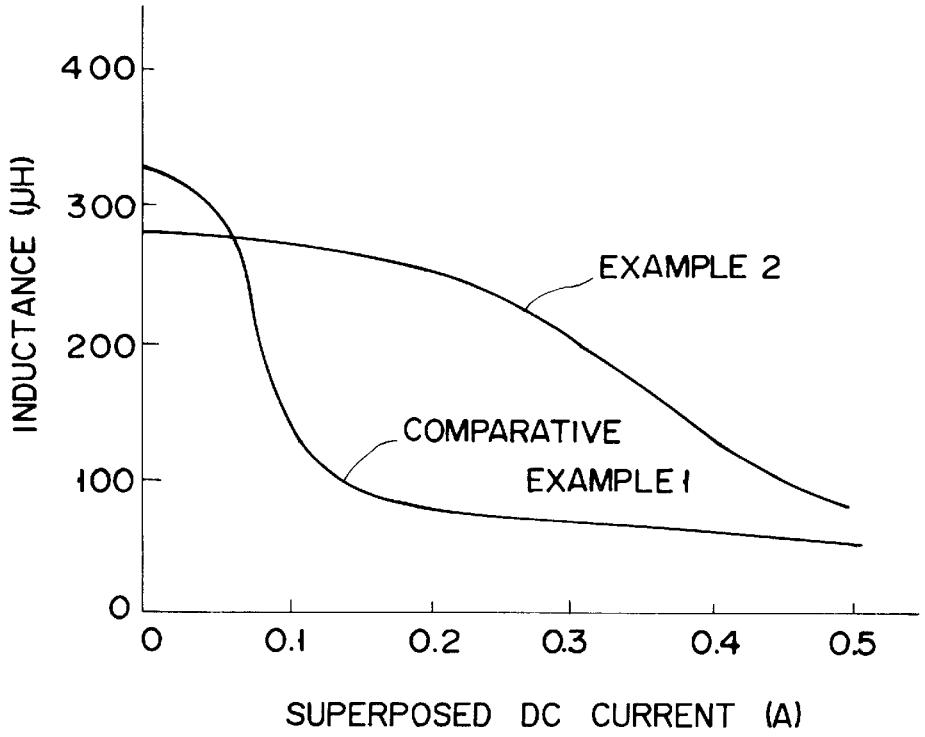
FIG. 8 is a graph showing a relationship between a superposed DC current and an inductance of each planar inductor according to Example 2 and Comparative Example 1 of the present invention.
Figure 9:
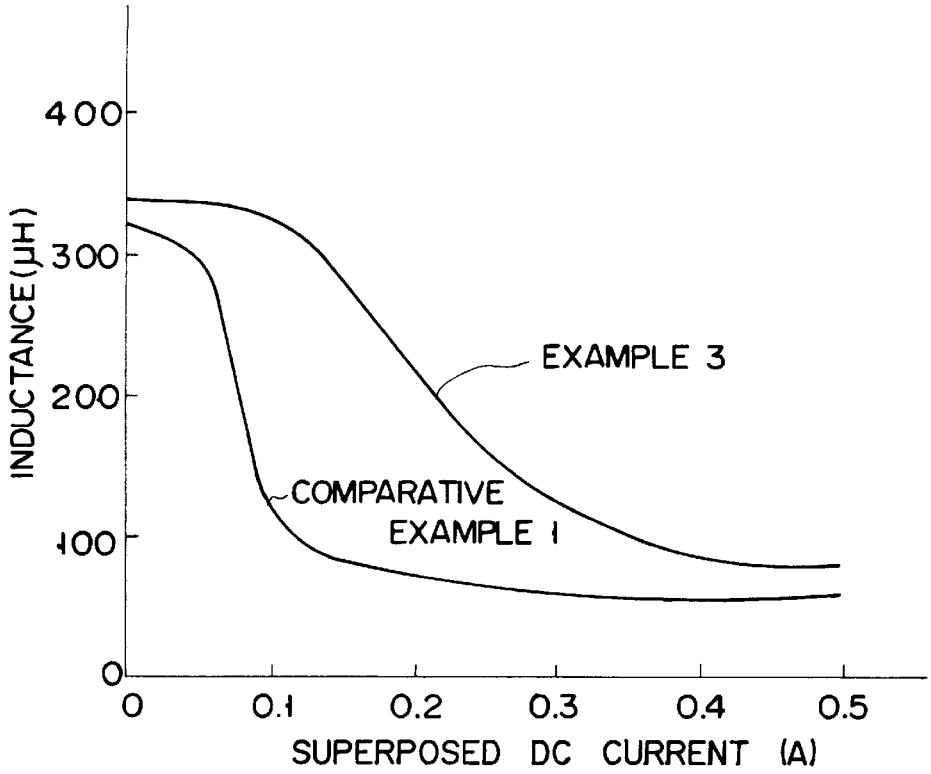
FIG. 9 is a graph showing a relationship between a superposed DC current and an inductance of each planar inductor according to Example 3 and Comparative Example 1 of the present invention.

Each of FIGS. 7 to 9 shows a relationship between a superposed DC current and an inductance of the planar inductors according to Examples 1 to 3, and Comparative Example 1. The inductance was measured at a frequency of 50 kHz.

As shown in FIGS. 7 to 9, in the planar inductors in Examples 1 to 3, each DC superposition characteristic was largely improved as compared with that in the planar inductor in Comparative Example 1.

EXAMPLE 4 AND COMPARATIVE EXAMPLE 2

Figure 2:
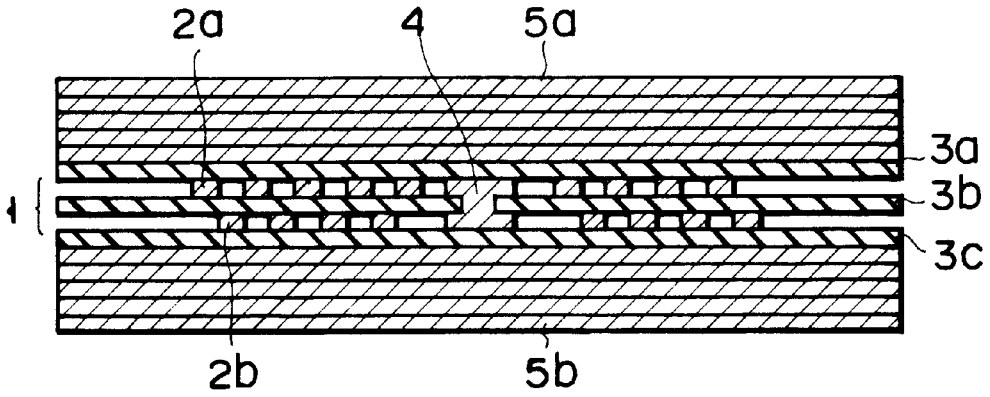
FIG. 2 is a sectional view of planar inductors according to Example 4 and Comparative Example 2 of the present invention.

A planar inductor shown in FIG. 2 was manufactured in Example 4 and Comparative Example 2.

EXAMPLE 4

Five square samples each having a side of 25 mm were prepared from an amorphous alloy ribbon having the composition, the mean thickness, and the width which were equal to those of the ribbon in Example 1, and were stacked. After a heat treatment for eliminating a strain was performed for the stacked body, the resultant body was used as a ferromagnetic layer.

COMPARATIVE EXAMPLE 2

Five square samples each having a side of 25 mm were prepared from an amorphous alloy ribbon having the composition, the mean thickness, and the width which were equal to those of the ribbon in Comparative Example 1, and were stacked. After a heat treatment for eliminating a strain was performed for the stacked body, the resultant body was used as a ferromagnetic layer.

Figure 10:
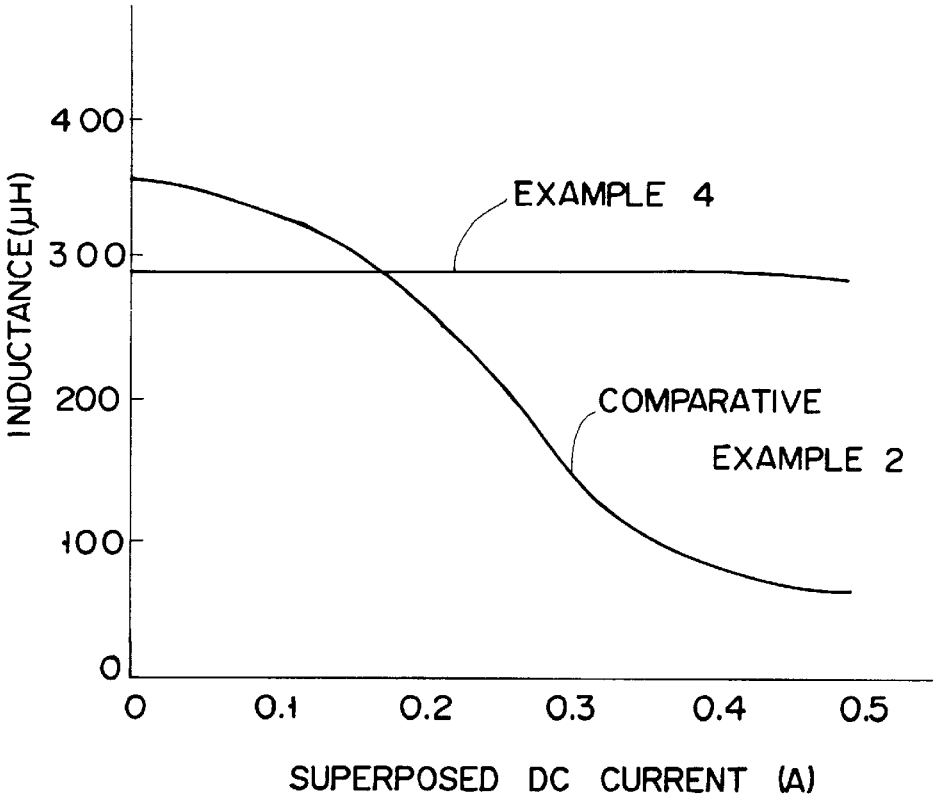
FIG. 10 is a graph showing a relationship between a superposed DC current and an inductance of each planar inductor according to Example 4 and Comparative Example 2 of the present invention.

FIG. 10 shows a relationship between a superposed DC current and an inductance of the planar inductors in Example 4 and Comparative Example 2. Note that the inductance was measured at a frequency of 50 kHZ.

As shown in FIG. 10, in the planar inductor in Example 4, the DC superposition characteristic was largely improved as compared with that in the planar inductor in Comparative Example 2.

An efficiency when the planar inductor with the same structure manufactured using a ferromagnetic ribbon having a different saturation magnetization was applied to a non-insulated voltage-drop type DC-to-DC converter of 5-V output 2-W class will be described hereinafter.

Figure 11:
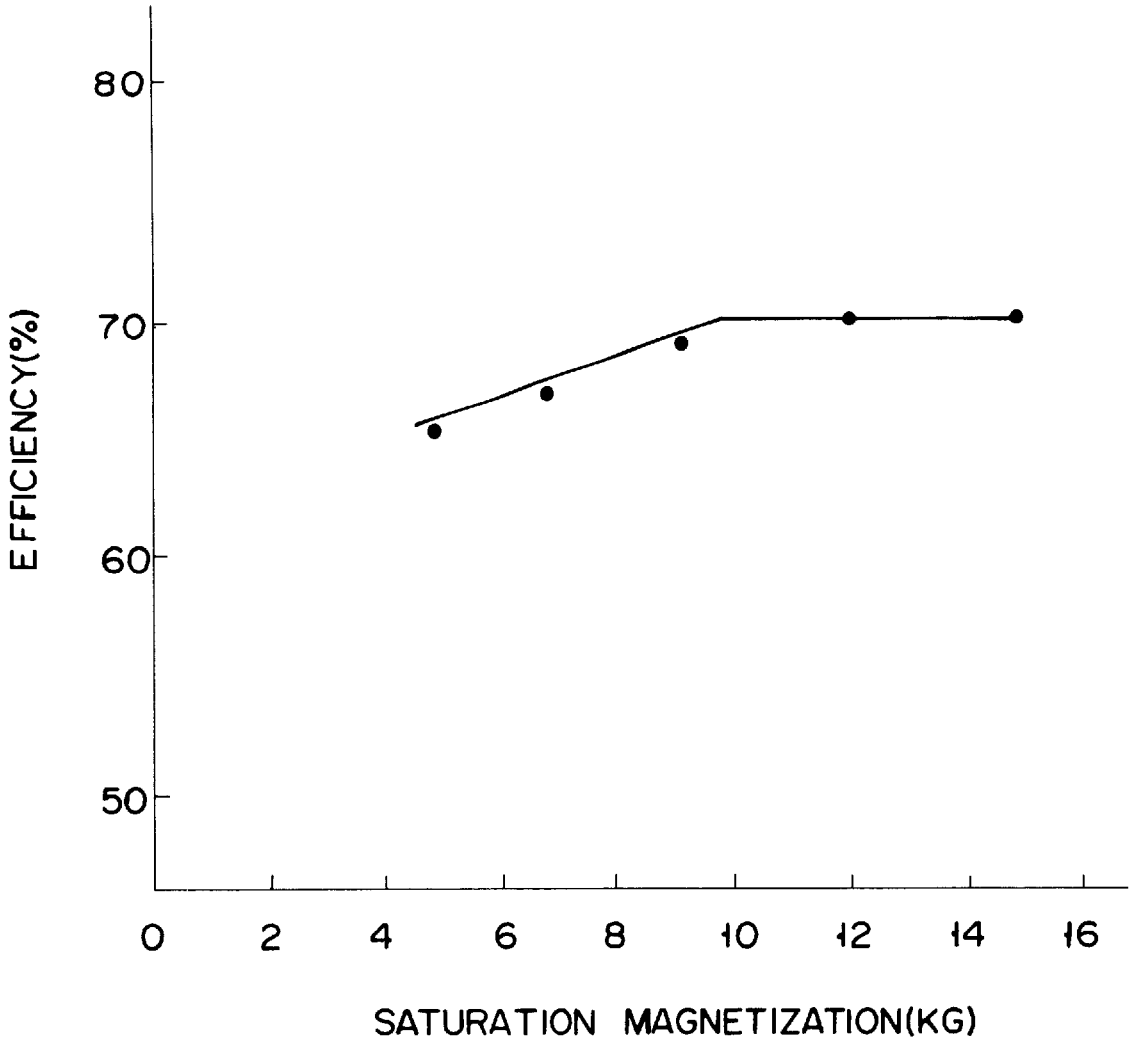
FIG. 11 is a graph showing a relationship between a saturation magnetization of a ferromagnetic ribbon which constitutes the planar inductor according to the present invention and an efficiency of a noninsulated voltage-drop type DC-to-DC converter to which the planar inductor is applied.

FIG. 11 shows a relationship between a saturation magnetization $4\pi M_S$ of an amorphous alloy ribbon and an efficiency n of a DC-to-DC converter. The DC-to-DC converter was applied a planar inductor constituted of a spiral coil (thickness: about 1 mm) having an air-core inductance of 54 μH, and a coil resistance of 1.8ω, polyimide films having a thickness of 7.5 μm stacked on both surfaces of the spiral coil, and five-layered bodies of Co-or Fe-based amorphous alloy ribbons (thickness: about 15 μm) stacked on the polyimide films. The efficiency was measured under the conditions of an input voltage of 15 V, an output voltage of 5 V, and an output current of 0.4 A.

As shown in FIG. 11, the efficiency η obtained when an amorphous alloy ribbon ($4\pi M_s \geqq 10$ kG) was used was substantially constant, i.e., about 70%. However, when an amorphous alloy ribbon ($4\pi M_S<10$ kG) was used, an inductance was degraded because of the superposed DC current, and the efficiency was decreased.

EXAMPLES 5 & 6, AND REFERENCE EXAMPLES 1–3

Figure 3:
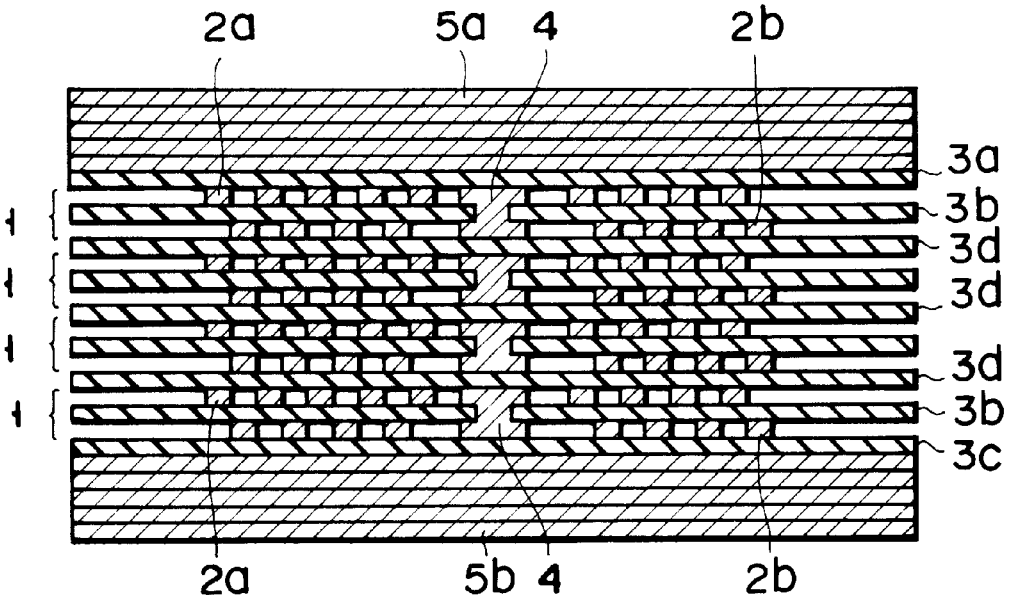
FIG. 3 is a sectional view of planar inductors according to Examples 5 and 6 and Reference Examples 1 to 3 of the present invention.

In Examples 5 and 6, and Reference Examples 1 to 3, a planar inductor of a multi-layered type shown in FIG. 3 was manufactured.

Cu foils each having a thickness of 100 μm were applied on both surfaces of a polyimide film having a thickness of 25 μm, and the Cu foils were connected via a through hole in a central portion to prepare a double-sided FPC board. The Cu foils on both the surfaces were etched to obtain spiral conductors each having an outer size of 20 mm×20 mm, a coil width of 250 μm, a coil pitch of 500 m, and the number of turns of the coil of 40 (20 turns for each surface), thus manufacturing the spiral coil. Tow spiral coils were stacked with polyimide film having a thickness of 7 μm (the insulating layers 3*d*) interposed between the coils and the coils were electrically connected in parallel to manufacture a multi-layered coil. In addition, two multilayered coils were stacked with the polyimide film (the insulating layers 3*d*) having a thickness of 7 μm, interposed between the multi-layered coils and the multi-layered coils were electrically connected in series to manufacture a multi-layered coil (four-layered coil). Polyimide films (the insulating layers 3*a* and 3*c*) each having a thickness of 7 $\mu$m were stacked on both surfaces of the multi-layered coil, and a square five-layered ferromagnetic ribbon having a side of 25 mm were further stacked on the polyimide films, thus manufacturing the planar inductor. Note that the ferromagnetic ribbon has a square shape having a side of 25 mm obtained by combining a plurality of two-dimensionally divided portions, or without two-dimensionally dividing.

EXAMPLE 5

Figure 4:
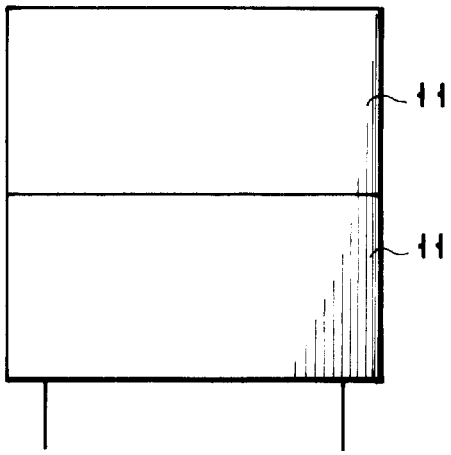
FIG. 4 is a plan view of planar inductors according to Examples 5 and 6 and Reference Example 2 of the present invention.

Five rectangular samples each having sides of 25 mm×12.5 mm were prepared from an amorphous alloy ribbon having the composition, the mean thickness, and the width which were equal to those of the ribbon in Example 1, and were stacked to manufacture a multi-layered body. As shown in FIG. 4, after a heat treatment for eliminating a strain was performed for the multi-layered body 11, two such multi-layered bodies 11 were aligned in a horizontal direction without gaps on a single plane to obtain a square structure having a side of 25 mm, and the square structure was used as a ferromagnetic layer.

EXAMPLE 6

Five square samples each having a side of 25 mm were prepared from an amorphous alloy ribbon having the composition, the mean thickness, and the width which were equal to those of the ribbon in Example 1, and were stacked to manufacture a multi-layered body. After a heat treatment for eliminating a strain was performed for a multi-layered body, the resultant body was used as a ferromagnetic layer.

Figure 12:
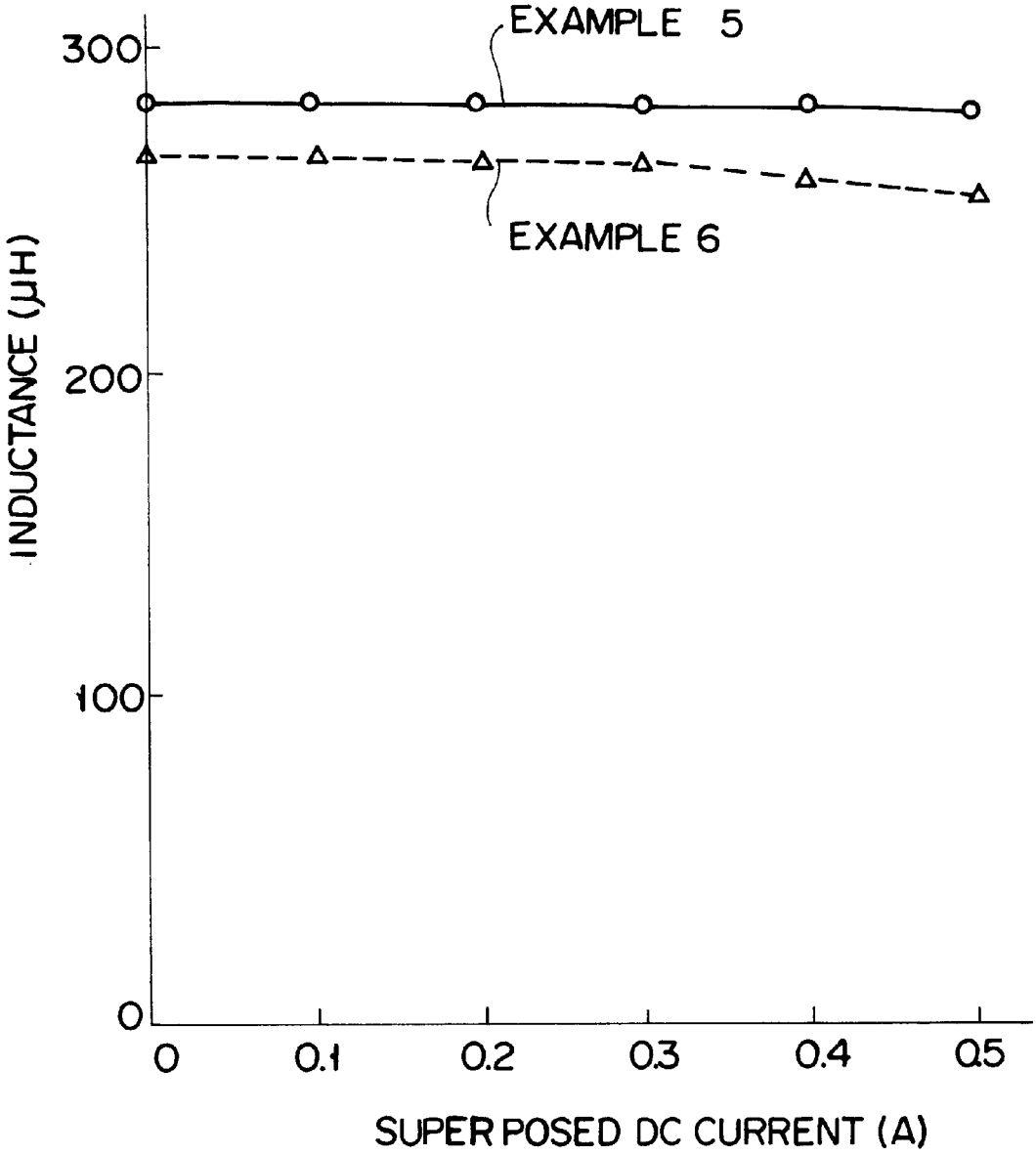
FIG. 12 is a graph showing a relationship between a superposed DC current and an inductance of each planar inductor according to Examples 5 and 6 of the present invention.
Figure 13:
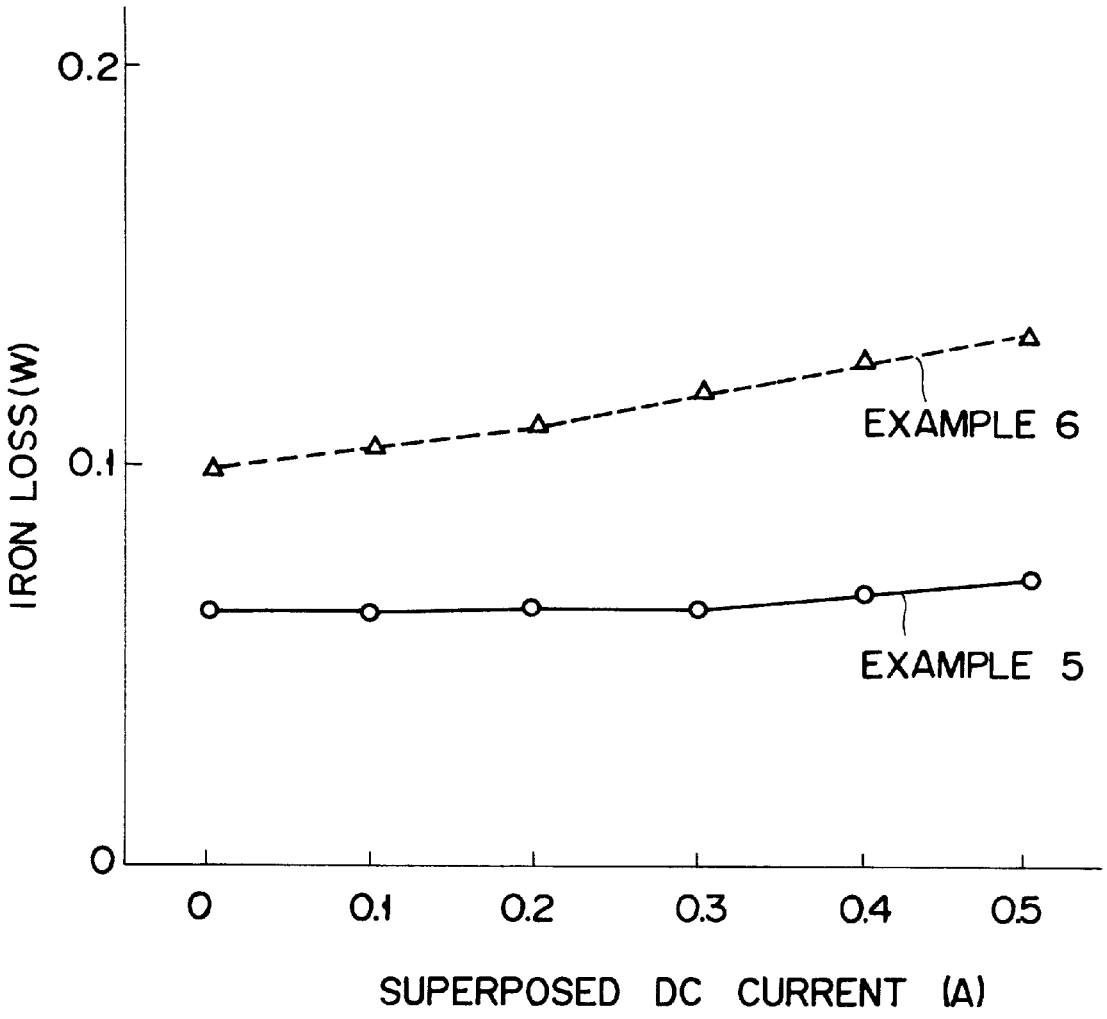
FIG. 13 is a graph showing a relationship between a superposed DC current and an iron loss of each planar inductor according to Examples 5 and 6 of the present invention.
Figure 14:
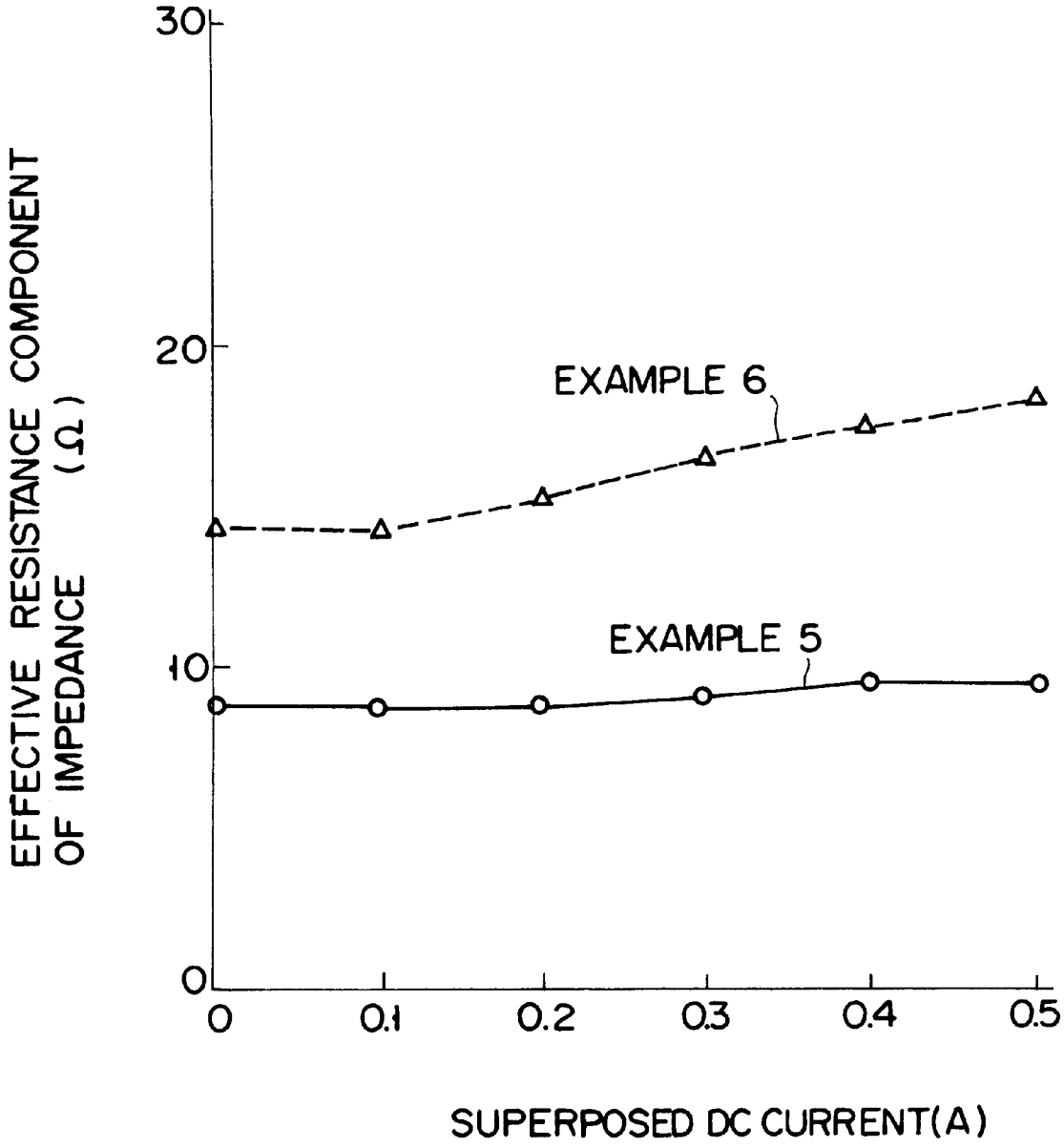
FIG. 14 is a graph showing a relationship between a superposed DC current and an effective resistance component of an impedance of each planar inductor according to Examples 5 and 6 of the present invention.
Figure 15:
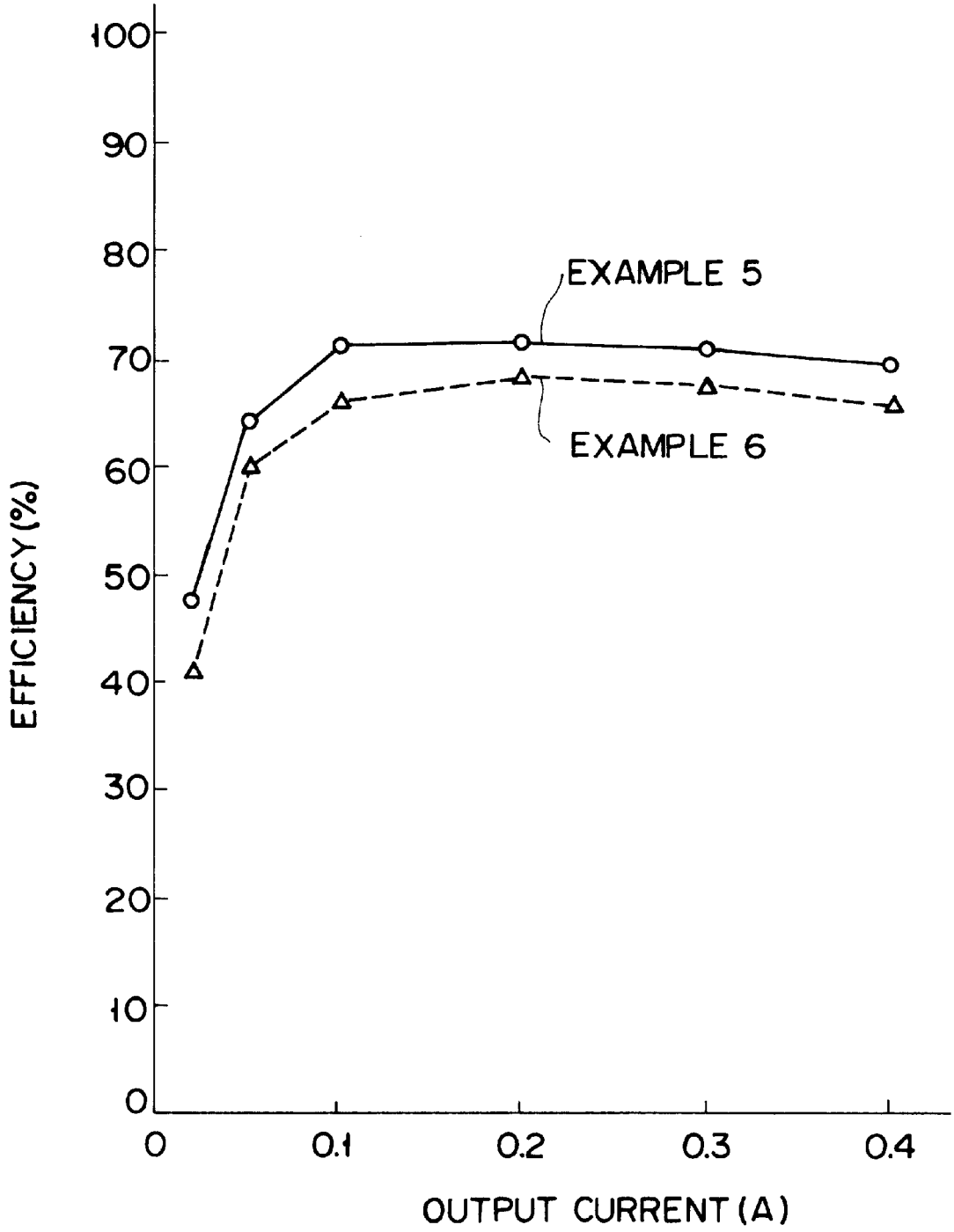
FIG. 15 is a graph showing a relationship between an output current and an efficiency of the noninsulated voltage-drop type DC-to-DC converter constituted by each planar inductor according to Examples 5 and 6 of the present invention.

Various characteristics of the planar inductors in Examples 5 and 6 were examined. FIG. 12 shows a relationship between a superposed DC current and an inductance. FIG. 13 shows a relationship between a superposed DC current and an iron loss. FIG. 14 shows a relationship between a superposed DC current and an effective resistance component of an impedance. FIG. 15 shows a relationship between an output current and an efficiency $\eta$ of a noninsulated voltage-drop type DC-to-DC converter of 5-V output 2-W class, which was constituted by the planar inductors.

As is apparent from FIGS. 12 to 15, in the planar inductor in Example 5 obtained by dividing the ferromagnetic layer into two portions, an inductance was slightly improved as compared with the planar inductor in Example 6 in which the ferromagnetic layer was not divided. In addition, when the iron loss was decreased, an effective resistance component of the impedance was decreased. As a result, a noninsulated voltage-drop type DC-to-DC converter using the planar inductor in Example 5 had an efficiency higher than that of the converter using the planar inductor in Example 6.

Note that in Examples 5 and 6, the ferromagnetic ribbon which satisfied the condition of $4\pi M_S \geqq 10$ kG was used. When the ferromagnetic ribbon was divided, the above-mentioned effect could be obtained even if a ferromagnetic ribbon which does not satisfy the condition of $4\pi M_S > 10$ kG is used. This will be described with reference to Reference Examples 1 to 3 below.

REFERENCE EXAMPLE 1

Figure 5:
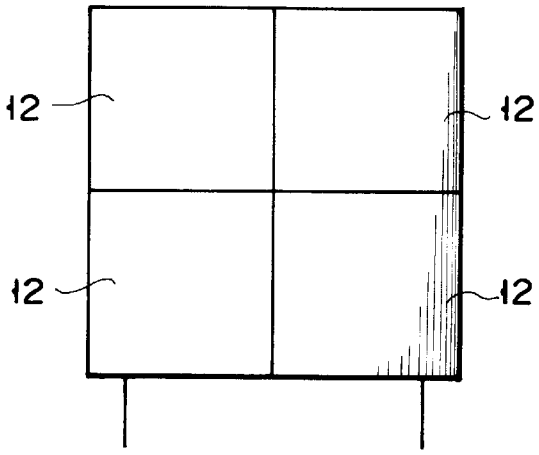
FIG. 5 is a plan view of the planar inductor according to Reference Example 1.
Figure 6:
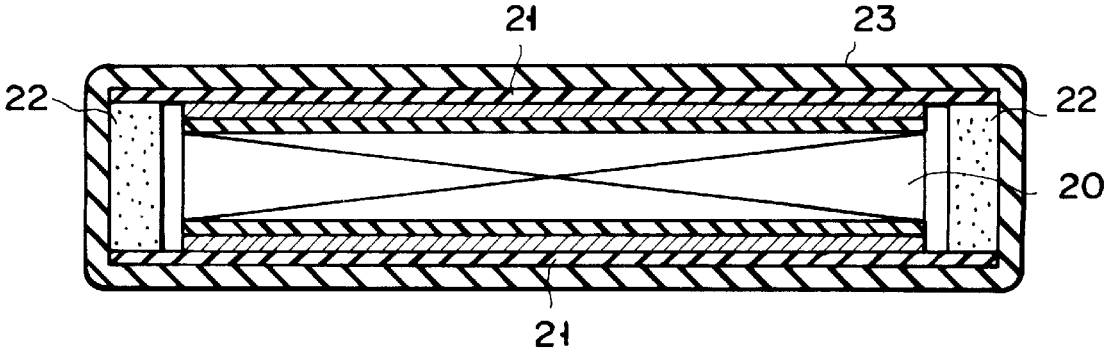
FIG. 6 is a sectional view of a planar inductor according to Example 7 of the present invention.

Five square samples each having a side of 12.5 mm were prepared from an amorphous alloy ribbon having the composition, the mean thickness, and the width which were equal to those of the ribbon in Comparative Example 1, and were stacked to manufacture a multi-layered body 12. As shown in FIG. 5, after a heat treatment for eliminating strain was performed for the multi-layered body 12, four such multi-layered bodies 12 were arranged in a horizontal direction without gaps on a single plane to obtain a square structure having a side of 25 mm, and the square structure was used as a ferromagnetic layer.

REFERNCE EXAMPLE 2

Five rectangular samples each having sides of 25 mm×12.5 mm were prepared from an amorphous alloy ribbon having the composition, the mean thickness, and the width which were equal to those of the ribbon in Comparative Example 1, and were stacked to manufacture a multi-layered body 11. As shown in FIG. 4, after a heat treatment for eliminating strain was performed for the multi-layered body 11, two such multi-layered bodies 11 were arranged in a horizontal direction without gaps on a single plane to obtain a square structure having a side of 25 mm, and the square structure was used as a ferromagnetic layer.

REFERENCE EXAMPLE 3

Five square samples each having a side of 25 mm were prepared from an amorphous alloy ribbon having the composition, the mean thickness, and the width which were equal to those of the ribbon in Comparative Example 1, and were stacked to manufacture a multi-layered body. After a heat treatment for eliminating strain was performed for the multi-layered body, the resultant body was used as a ferromagnetic layer.

Figure 16:
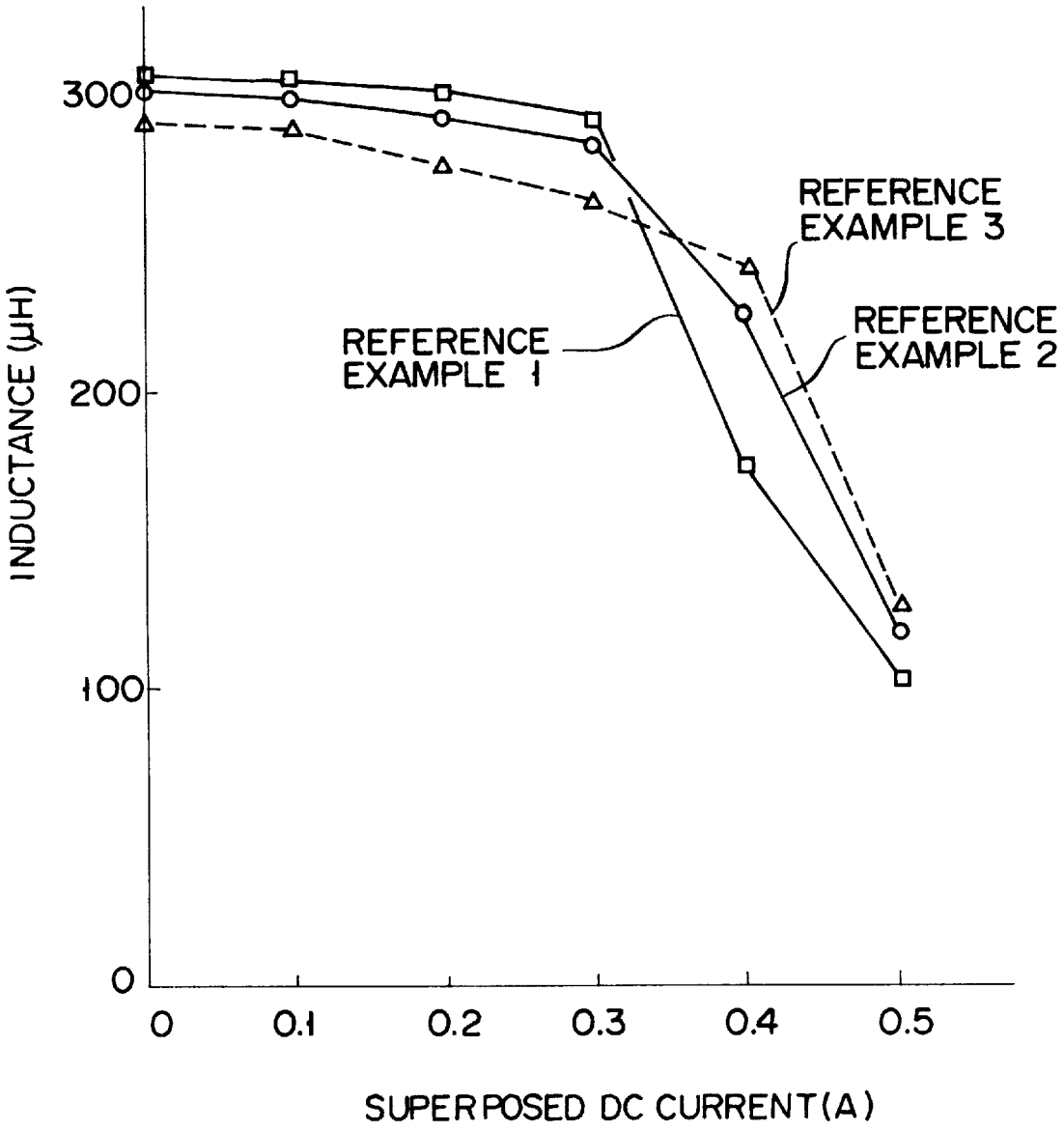
FIG. 16 is a graph showing a relationship between a superposed DC current and an inductance of each planar inductor according to Reference Examples 1 to 3.
Figure 17:
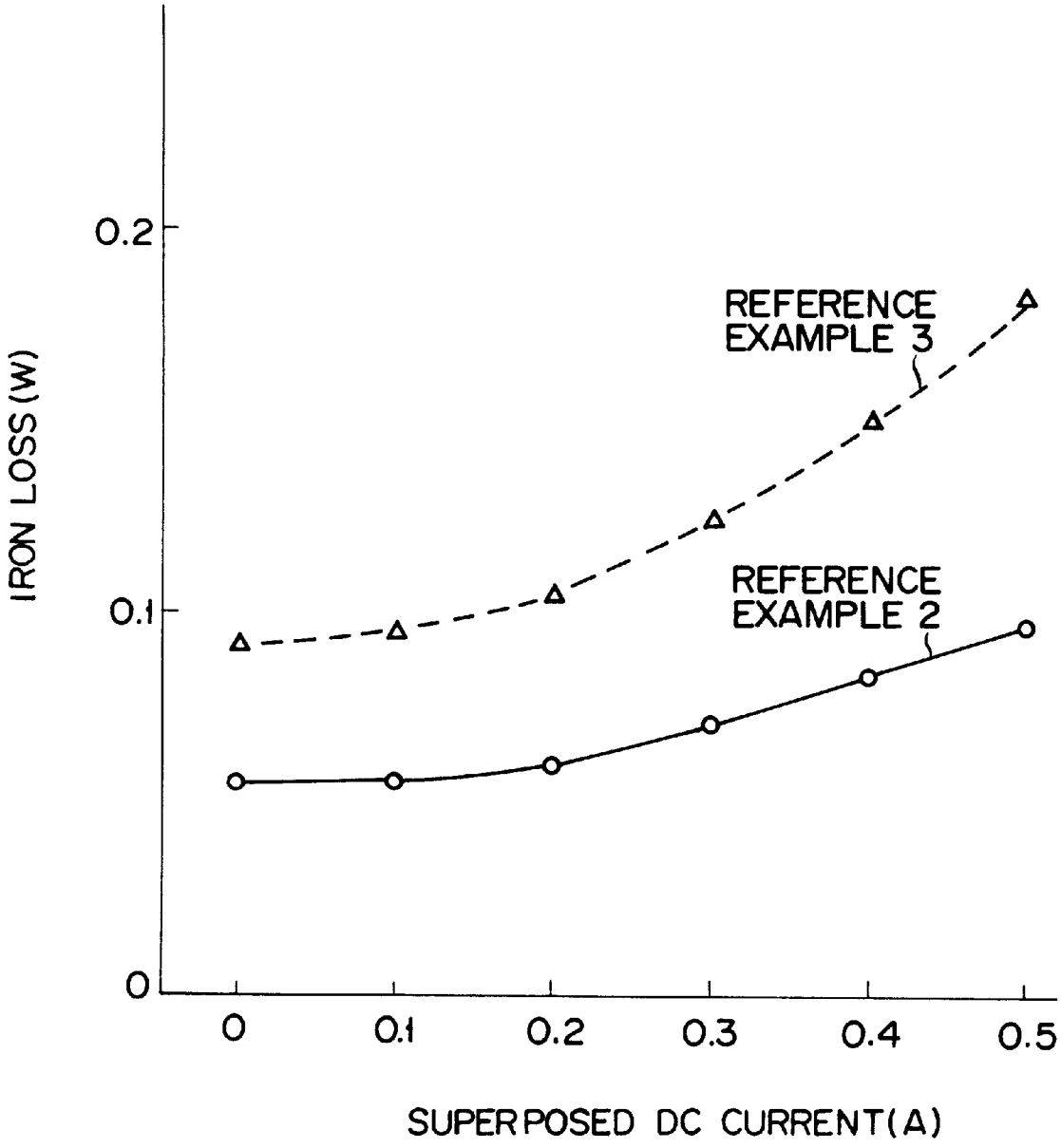
FIG. 17 is a graph showing a relationship between a superposed DC current and an iron loss of each planar inductor according to Reference Examples 1 and 2.
Figure 18:
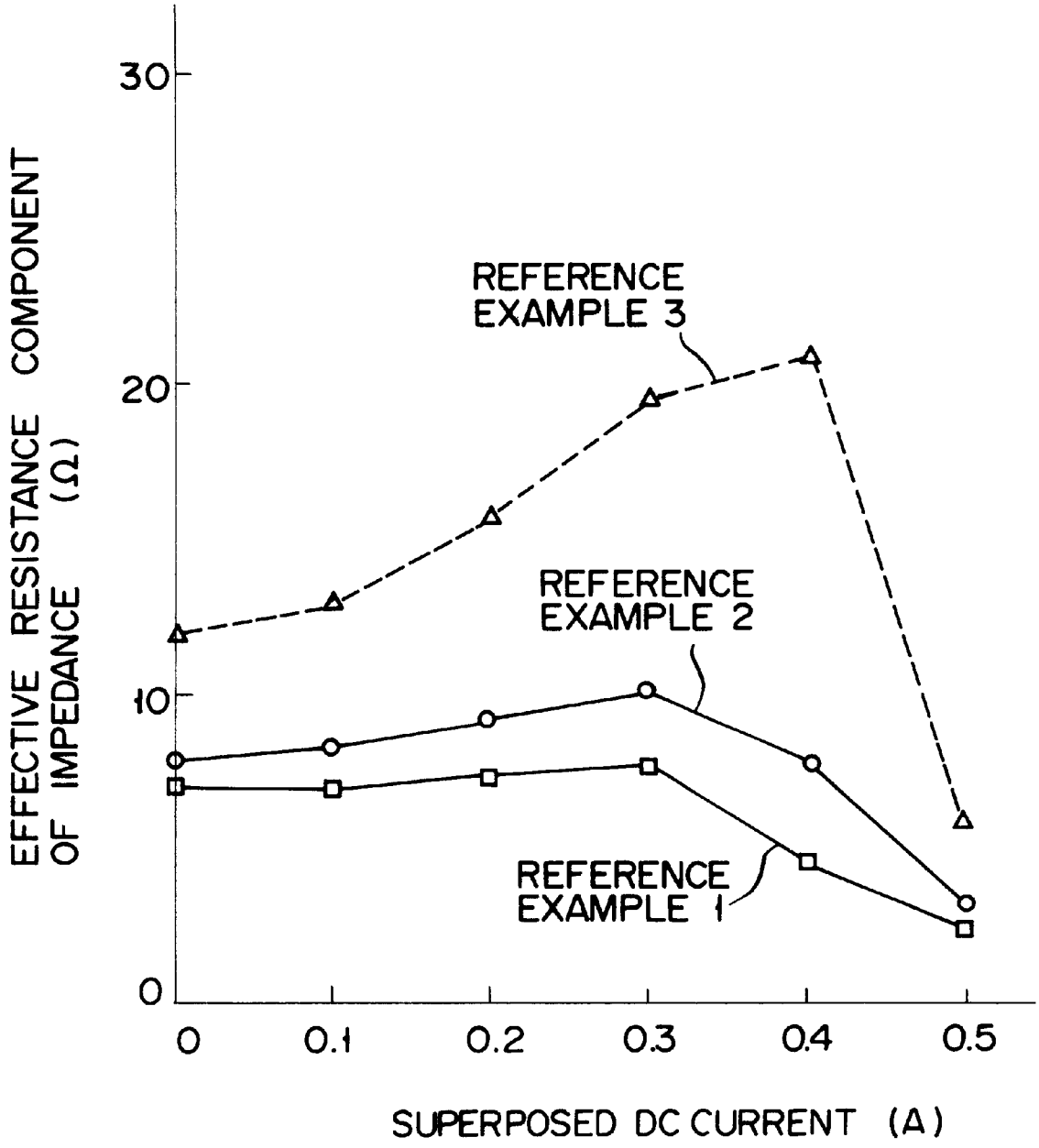
FIG. 18 is a graph showing a relationship between a superposed DC current and an effective resistance component of an impedance of each planar inductor according to Reference Examples 1 to 3.
Figure 19:
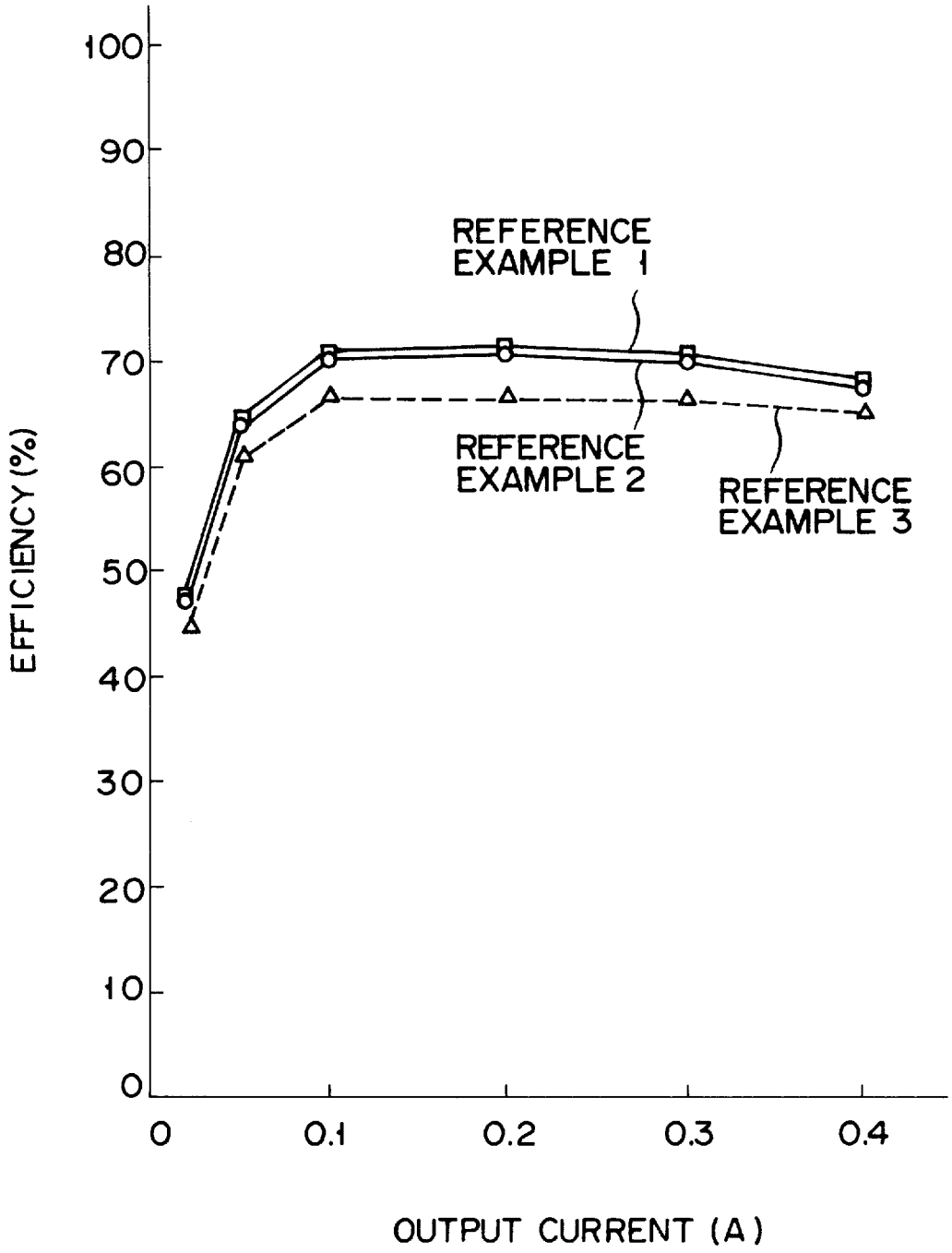
FIG. 19 is a graph showing a relationship between an output current and an efficiency of a noninsulated voltage-drop type DC-to-DC converter constituted by each planar inductor according to Reference Examples 1 to 3.

Various characteristics of the planar inductors in Reference Examples 1 to 3 were examined. FIG. 16 shows a relationship between a superposed DC current and an inductance. FIG. 17 shows a relationship between a superposed DC current and an iron loss. FIG. 18 shows a relationship between a superposed DC current and an effective resistance component of an impedance. FIG. 19 shows a relationship between an efficiency Ti and an output current of a noninsulated voltage-drop type DC-to-DC converter of 5-V output 2-W class, which was constituted by the planar inductors.

As shown in FIGS. 16 to 19, the same tendencies as in FIGS. 12 to 15 according to Examples 5 and 6 described above appear.

EXAMPLE 7 & 8

In Examples 7 and 8, an inductance when the planar inductor was covered with a mold resin was examined.

EXAMPLE 7

As shown in F a planar inductor 20 having a four-layered coil and a five-layered ferromagnetic ribbon which had an outer size of 25 mm×25 mm and which was manufactured in Examples 5 and 6 was used. PPS (polyphenylenesulfide resin) films 21 each having an outer size of 30 mm×30 mm, and a thickness of 100 $\mu$m were formed on both outer surfaces of the ferromagnetic ribbon. The side surfaces of the multi-layered coil were sealed with an adhesive 22 (Cemedine Super available from CEMEDINE CO., LTD.), so that when the multi-layered coil was dipped into a liquid mold resin in a subsequent step, the mold resin would not be brought into direct contact with the coil and the ferromagnetic ribbon. After the multi-layered coil was dipped into a mold resin 23 (Ceracoat 640–43 available from Hokuriku Toso K.K.), the coil was removed from the resin. After the coil was naturally dried for about one hour, the dried coil was heated at 150° C. for one hour to harden the mold resin 23, thus manufacturing a mold planar inductor.

EXAMPLE 8

A mold planar inductor was manufactured following the same procedures as in Example 7, except for the step of forming PPS films on both outer surfaces of a ferromagnetic ribbon, and the step of sealing the side surfaces of a multi-layered coil with an adhesive.

COMPARATIVE EXAMPLE 3

A planar inductor in this example had the same structure as that in Example 7, i.e., a structure having a four-layered coil and a five-layered ferromagnetic ribbon. In this planar inductor, the ferromagnetic ribbon consisted of square samples each having a side of 25 mm which were prepared from an amorphous alloy ribbon having a composition of $(Co_{0.88}Fe_{0.06}Nb_{0.02}Ni_{0.04})_{75}Si_{10}B_{15}$, a mean thickness of 16 $\mu$m, and a width of 25 mm was used, and a mold planar inductor was manufactured following the same procedures as in Example 7.

Figure 20:
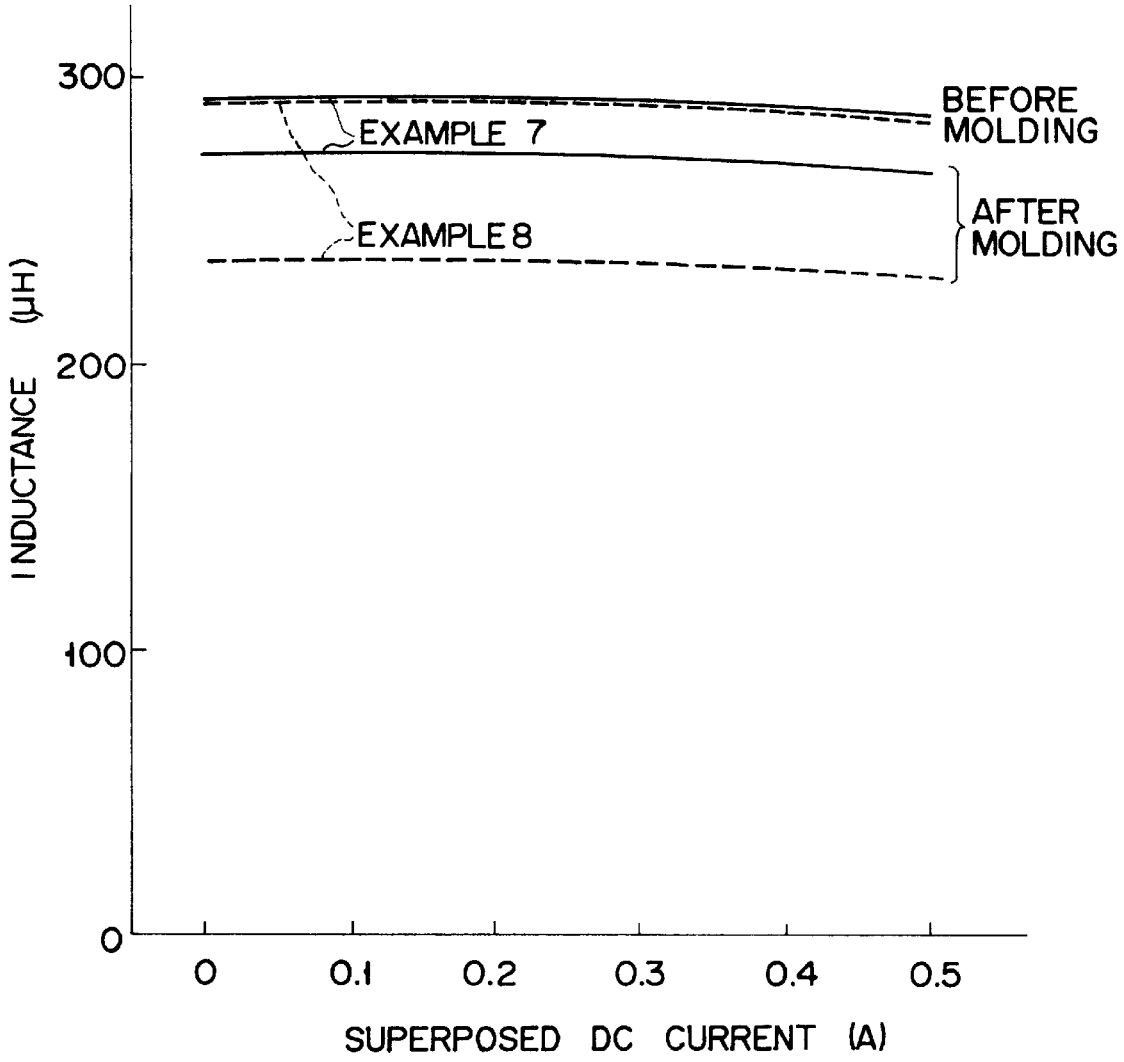
FIG. 20 is a graph showing a relationship between superposed DC current and an inductance before and after molding of a planar inductor according to Examples 7 and 8 of the present invention.
Figure 21:
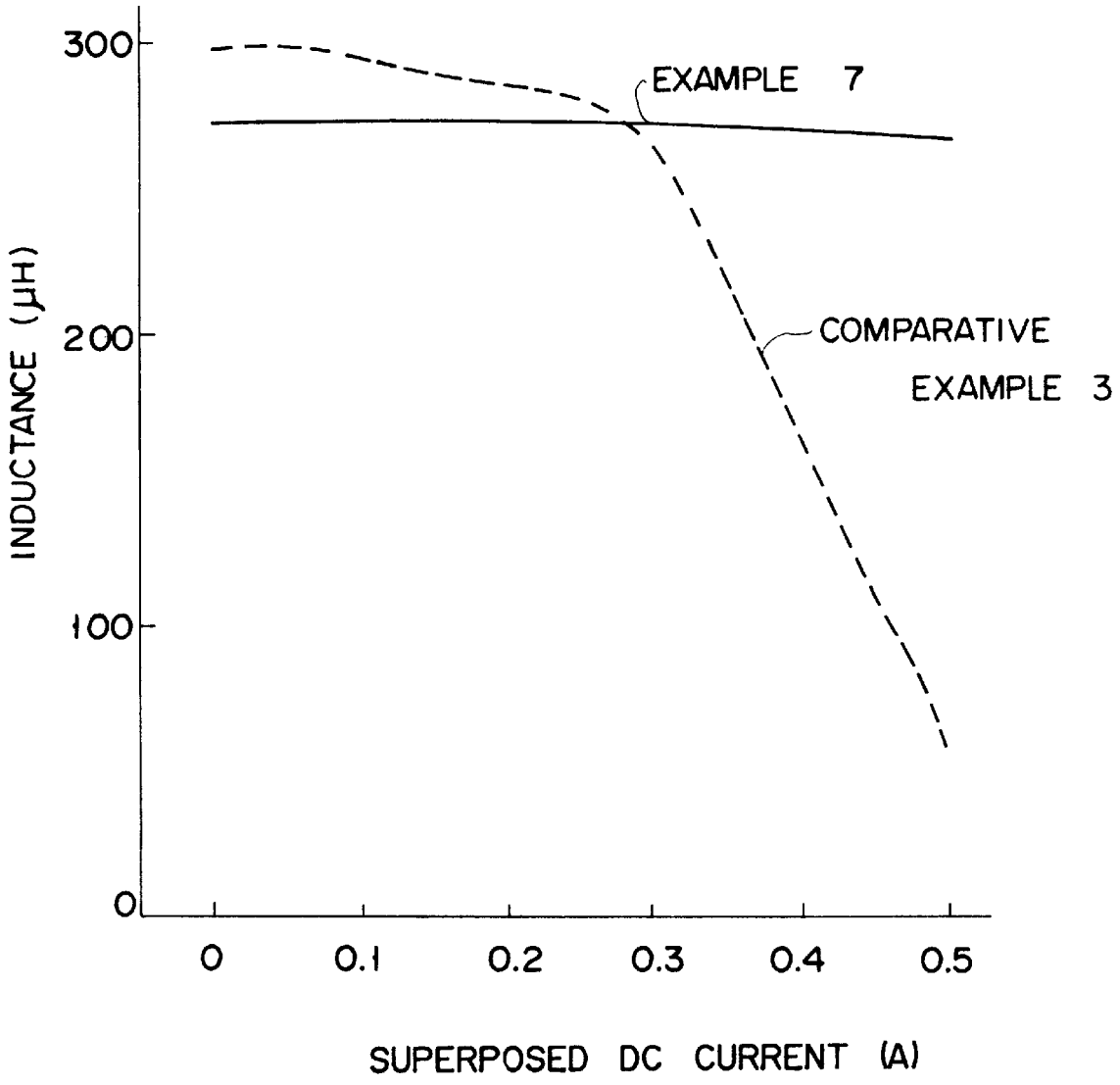
FIG. 21 is a graph showing a relationship between superposed DC current and an inductance after molding of the planar inductor according to Example 7 and Comparative Example 3 of the present invention.

FIG. 20 shows a relationship between a superposed DC current and an inductance before and after molding of the planar inductors in Examples 7 and 8. FIG. 21 shows a relationship between a superposed DC current and an inductance after molding of the planar inductors in Example 7 and Comparative Example 3.

As is apparent from FIG. 20, in the mold planar inductor without PPS films on both outer surfaces of the ferromagnetic ribbon in Example 8, an inductance after molding is lower than that before molding by about 20%. On the contrary, in the mold planar inductor with PPS films on both outer surfaces of the ferromagnetic ribbon in Example 7, an inductance after molding is lower than that before molding by only about 7%. As is apparent from FIG. 21, the mold planar inductor in Comparative Example 3, which employs the amorphous alloy ribbon having an insufficient saturation magnetization is different from the mold planar inductor in Example 7, as follows. That is, when a superposed DC current is 0.3 A or more, an inductance is considerably reduced.

Note that although a case wherein a spiral coil is used as a planar inductance element is described with reference to the above embodiments, a coil having another shape such as a meander coil may be used as the planar inductance element.

What is claimed is:

1. A planar inductor, comprising:

a planar inductance element comprising a coil having a plurality of windings, the plurality of windings all extending in the same plane; and at least one ferromagnetic layer stacked on said planar inductance element;

wherein said at least one ferromagnetic layer comprises a plurality of ferromagnetic sub-layers stacked directly upon one another with no intervening structure between the plurality of sub-layers.

2. The planar inductor according to claim 1, wherein a saturation magnetization $4\pi M_S$, of said at least one ferromagnetic layer is not less than 10 Kg.

3. The planar inductor according to claim 1, wherein the thickness of each of said plurality of sub-layers is between 4 and 100 $\mu$m.

4. The planar inductor according to claim 1, wherein an effective permeability $\mu_{10k}$ at a frequency of 10 kHz of said at least one ferromagnetic layer is not less than $1\times10^4$.

5. The planar inductor according to claim 1, wherein said at least one ferromagnetic layer consists of an amorphous alloy ribbon whose composition is represented by the following formula:

$$(Fe_{1-a}M_a)_{100-b}X_b$$

wherein M is at least one of Ti, V, Cr, Mn, Co, Ni, Zr, Nb, Mo, Hf, Ta, W, and Cu, and X is at least one of Si, B, P, C, Ge, and Al, and $0\leqq a\leqq 0.15$, and $12\leqq b<30$.

6. The planar inductor according to claim 1, wherein said at least one ferromagnetic layer consists of a hyperfine grain alloy ribbon obtained by thermally treating an Fe-based amorphous alloy ribbon at a temperature that is higher than a crystallization temperature of said Fe-based amorphous alloy ribbon.

7. The planar inductor according to claim 1, wherein insulating layers and ferromagnetic layers are stacked on both surfaces of said planar inductance element.

8. The planar inductor according to claim 7, wherein said planar inductance element comprises a spiral coil.

9. The planar inductor according to claim 7, wherein said planar inductance element has a structure obtained by stacking a plurality of spiral coils with insulating layers interposed therebetween.

10. The planar inductor according to claim 1, further comprising:

a coating of a mold resin surrounding said planar inductor element and said at least one ferromagnetic layer; and a relaxation layer formed on said ferromagnetic layer, for providing strain relaxation due to contraction of said coating of a mold resin when said coating of a mold resin is hardened.

11. The planar inductor according to claim 10, wherein said relaxation layer consists of an organic polymer film, said organic polymer film having a thermal deformation temperature which is higher than a hardening temperature of the mold resin.

12. The planar inductor according to claim 11, wherein said organic polymer film consists of polyphenylenesulfide.

13. The planar inductor according to claim 11, wherein the thickness of said organic polymer film is less than 20 $\mu$m.

14. An inductor according to claim 1, wherein said plurality of sub-layers comprises at least three sub-layers.

15. A planar inductor, comprising:

a laminated structure including a spiral conductor coil means for conducting a current, said spiral conductor coil means is sandwiched between ferromagnetic layers, each ferromagnetic layer comprising a plurality of ferromagnetic ribbons which are sandwiched together, each ferromagnetic ribbon having a thickness of not more than 100 microns.

16. A planar inductor comprising:

a first ferromagnetic layer;

a coil stacked on said first ferromagnetic layer;

a second ferromagnetic layer stacked on said coil;

wherein the first ferromagnetic layer comprises a plurality of ferromagnetic sub-layers that are stacked upon one another; and wherein there are no coils between the stacked plurality of ferromagnetic sub-layers.

17. A planar inductor, comprising:

a first ferromagnetic layer;

a coil stacked upon said first ferromagnetic layer;

a second ferromagnetic layer stacked upon said coil so that the coil is sandwiched between the first and second ferromagnetic layers;

wherein the first ferromagnetic layer comprises a plurality of a sub-layers that are stacked upon one another and the second ferromagnetic layer comprises a plurality of sub-layers that are stacked upon one another; and wherein all coils of the planar inductor are disposed between the first and second ferromagnetic layers.

18. A planar inductor, comprising:

a planar inductance element; and at least one ferromagnetic layer stacked on said planar inductance element;

where said ferromagnetic layer is two-dimensionally divided into a plurality of ferromagnetic portions.

19. A planar inductor having an inductance, comprising:

at least one ferromagnetic layer, each ferromagnetic layer having a saturation magnetization that is greater than 10 kG and a thickness of less than 100 microns; and a coil stacked on said ferromagnetic layer and having a Plurality of windings, the Plurality of windings all extending in the same plane.

20. A planar inductor according to claim 19, wherein said each layer of the plurality of ferromagnetic layers has an effective magnetic permeability of 10,000 at 10 Khz.

21. A planar inductor according to claim 19, further comprising:

an insulating layer interposed between said coil and said ferromagnetic layer.

22. A planar inductor according to claim 19, wherein:

said saturization magnetization is greater than 12 kilogauss.

23. A planar inductor according to claim 19, further comprising:

a plurality of stacked spiral coils; and an insulating layer between each pair of adjacent coils.

24. A planar inductor according to claim 19, wherein:

said at least one ferromagnetic layer comprises a plurality of ferromagnetic layers.

25. An inductor according to claim 19, wherein said at least one ferromagnetic layer comprises at least three ferromagnetic layers.

26. A planar inductor, comprising:

a laminated structure including a spiral conductor coil means for conducting a current, said spiral conductor coil means comprises a plurality of windings, the plurality of windings all extending in the same plane, wherein said spiral conductor coil means is sandwiched between ferromagnetic layers, each of said ferromagnetic layers comprising a plurality of ferromagnetic ribbons which are sandwiched together; and wherein an effective permeability at 10 kilohertz of each ferromagnetic layer is at least $1\times10^4$.

27. An inductor according to claim 26, wherein said plurality of ferromagnetic ribbons comprises at least three ferromagnetic ribbons.

28. A planar inductor comprising a laminated structure including a planar inductance element comprising a plurality of windings, the plurality of windings all extending in the same plane, said planar inductance element is sandwiched between ferromagnetic layers each including a plurality of ferromagnetic ribbons, each one of said plurality of ferromagnetic ribbons having a thickness of 100 microns or less.

29. A planar inductor according to claim 28, further comprising:

insulating layers interposed between the planar inductance element and said ferromagnetic layers.

30. A planar inductor according to claim 29, wherein the thickness of each ferromagnetic ribbon is in the range between 4 and 100 microns.

31. A planar inductor according to claim 29, wherein each ferromagnetic layer has a thickness and a side length, and a ratio of the thickness to the side length of each ferromagnetic layer, composed of a plurality of ferromagnetic ribbons, falls within the range between $2\times10^{-4}$ and $1\times10^{-2}$.

32. An inductor according to claim 28, wherein said plurality of ferromagnetic ribbons comprises at least three ferromagnetic ribbons.

33. A planar inductor, comprising:

a planar inductance element comprising a plurality of conducting coils which are stacked upon one another and separated from one another only by an insulating non-ferromagnetic layer, each of said conducting coils comprising a plurality of windings, a first plurality of windings for a first one of the Plurality of conducting coils all extending in the same plane; and at least one ferromagnetic layer stacked on said planar inductance element;

wherein said at least one ferromagnetic layer is formed from a plurality of ferromagnetic sub-layers that are stacked upon one another and each of the plurality of ferromagnetic sub-layers has a thickness of 100 microns or less.

34. A planar inductor according to claim 33, wherein a saturation magnetization of said at least one ferromagnetic layer is not less than 10 Kg.

35. A planar inductor according to claim 33, wherein a thickness of each of said plurality of sub-layers is between 4 and 100 microns.

36. A planar inductor according to claim 33, wherein an effective magnetic permeability at a frequency of 10 kHz of said at least one ferromagnetic layer is not less than $1\times10^4$.

37. An inductor according to claim 33, wherein said plurality of sub-layers comprises at least three sub-layers.

38. A planar inductor, comprising:

a planar inductance element comprising a plurality of windings, the plurality of windings all extending in the same plane; and at least one ferromagnetic layer stacked on said planar inductance element;

wherein said at least one ferromagnetic layer comprises a plurality of ferromagnetic sub-layers which are stacked upon one another and form said ferromagnetic layer and have no electrically conductive material between them.

39. An inductor according to claim 38, wherein each of said plurality of ferromagnetic sub-layers is less than 10 microns thick and greater than 7 microns thick.

40. An inductor according to claim 38, wherein said plurality of ferromagnetic sub-layers comprises at least three ferromagnetic sub-layers.

41. A planar conductor comprising a laminated structure including spiral conductor coil means sandwiched between ferromagnetic layers each including a plurality of ferromagnetic ribbons, each of said ferromagnetic ribbons having a thickness of 100 microns or less.

42. An inductor according to claim 41, wherein a saturation magnetization of each of said ferromagnetic layers is not less than 10 kilogauss.

43. The inductor according to claim 41, wherein the thickness of each of said plurality of ferromagnetic ribbons is between 4 and 100 microns.

44. The inductor according to claim 41, wherein an effective permeability at a frequency of 10 kilohertz of each of said ferromagnetic layers is not less than $1\times10^4$.

45. An inductor according to claim 41, wherein said spiral conductor coil means comprises a plurality of coils with insulating layers interposed therebetween to form a stack of the plurality of coils and the insulating layers.

* * * * *